United States Patent [19]

Málasek et al.

[11] 4,134,434

[45] Jan. 16, 1979

[54] WEFT CUTTING DEVICE IN LOOMS WITH MECHANISMS FOR MULTI WEFT WEAVING

[75] Inventors: Jaromir Málasek, Brno; Vladimir Kuda, Blazovice; Vojmir Pozar, Budisov, all of Czechoslovakia

[73] Assignee: Vyzkumny a vyvojovy ustav Zavodu vseobecneho strojirenstvi, Brno, Czechoslovakia

[21] Appl. No.: 861,880

[22] Filed: Dec. 19, 1977

Related U.S. Application Data

[63] Continuation-in-part of Ser. No. 776,746, Mar. 11, 1977, abandoned.

[30] Foreign Application Priority Data

Nov. 11, 1976 [CS] Czechoslovakia ..... 1581-76

[51] Int. Cl.[2] ..... D03D 47/34

[52] U.S. Cl. ..... 139/429; 139/435; 139/302

[58] Field of Search ..... 139/196, 302, 303, 429, 139/430, 435, 450

[56] References Cited

U.S. PATENT DOCUMENTS

| | | | |
|---|---|---|---|
| 822,169 | 5/1906 | Walker et al. | 139/302 |
| 3,596,685 | 8/1971 | Bassart | 139/429 |
| 4,040,452 | 8/1977 | Santucci | 139/302 |

FOREIGN PATENT DOCUMENTS

| | | | |
|---|---|---|---|
| 2271320 | 12/1975 | France | 139/302 |

*Primary Examiner*—Henry S. Jaudon

[57] ABSTRACT

There is disclosed a device for cutting weft in looms with mechanisms for multi-weft weaving. The cutting device includes a holder on which mutually adjustable shields are mounted. The shields are provided with entrapping dents for the introduction and location of weft between the blades of cutting jaws at a cutting point. The cutting device has a movable jaw which is adjustably connected to a control lever. Adjustable shields and cutting jaws permit the use of the entire length of knife blades secured to the jaws. In this manner, during cutting the overlap is minimized and the lifetimes of the cutting edges and the cutting jaws are increased.

9 Claims, 10 Drawing Figures

WEFT CUTTING DEVICE IN LOOMS WITH MECHANISMS FOR MULTI WEFT WEAVING

This application is a continuation-in-part of application Ser. No. 776,746, filed Mar. 11, 1977, now abandoned.

FIELD OF THE INVENTION

The present invention relates to a device for cutting weft in looms with mechanisms for multi weft weaving.

BACKGROUND OF THE INVENTION

Unconventional looms, particularly those adapted for pneumatic or hydraulic weft insertion in which the weft length is prepared for each successive weft insertion, are provided with a device for weft cutting mounted at the input side of the machine, from the viewpoint of weft insertion.

Devices are known for cutting weft. These devices can be classified according to their construction and the time at which cutting actually takes place, i.e., before interlacing or after interlacing the inserted weft. A particular requirement is imposed on weft cutting when weaving with two or more wefts. In this case, in addition to a device for preparing the weft and inserting it, a device for controlling weft is required. The controlling device cooperates closely with the cutting device because, before the actual cutting, it is necessary to locate the inserted wefts from the separate nozzles in a predetermined sector corresponding to the position of the weft and the opening of the knife blades.

One of the weft cutting devices hitherto known is a device in which the weft is inserted into a shed from an outer weft supply bobbin. The device is controlled synchronously with the movement of the weft-inserting elements, and includes two mutually oppositely movably guided cutting jaws, of which each is provided with a blade. One of the blades is disposed on the edge of an entrapping dent in one of the cutting jaws. The entrapping dent is shielded from the shed and is opened towards the direction of weft insertion. The blades are positioned in a plane parallel to the direction of weft insertion.

Disadvantages of this known device include the difficulty of forming a shaped blade in one of the cutting jaws, and in the impossibility of using the whole length of the blade for cutting. The positioning of the blade in a plane parallel to the direction of weft insertion is also disadvantageous.

SUMMARY OF THE INVENTION

The above-mentioned disadvantages are mitigated in accordance with the present invention by a cutting device including a holder on which mutually adjustable shields are mounted. The shields are provided with entrapping dents for the introduction and location of weft between the blades of cutting jaws at a cutting point. The cutting device has a movable jaw which is adjustably connected to a control lever. Adjustable shields and cutting jaws permit the use of the entire length of knife blades secured to the jaws. In this manner, during cutting the overlapping of the blades is minimized and the lifetimes of the cutting edges and the cutting jaws are increased. It is desirable to cut the weft thread merely after the next weft insertion, just before beating up such next weft into the fell.

BRIEF DESCRIPTION OF THE DRAWINGS

An embodiment of the device according to the present invention is shown in the accompanying drawings in which.

DETAILED DESCRIPTION

Figures 1, 2:
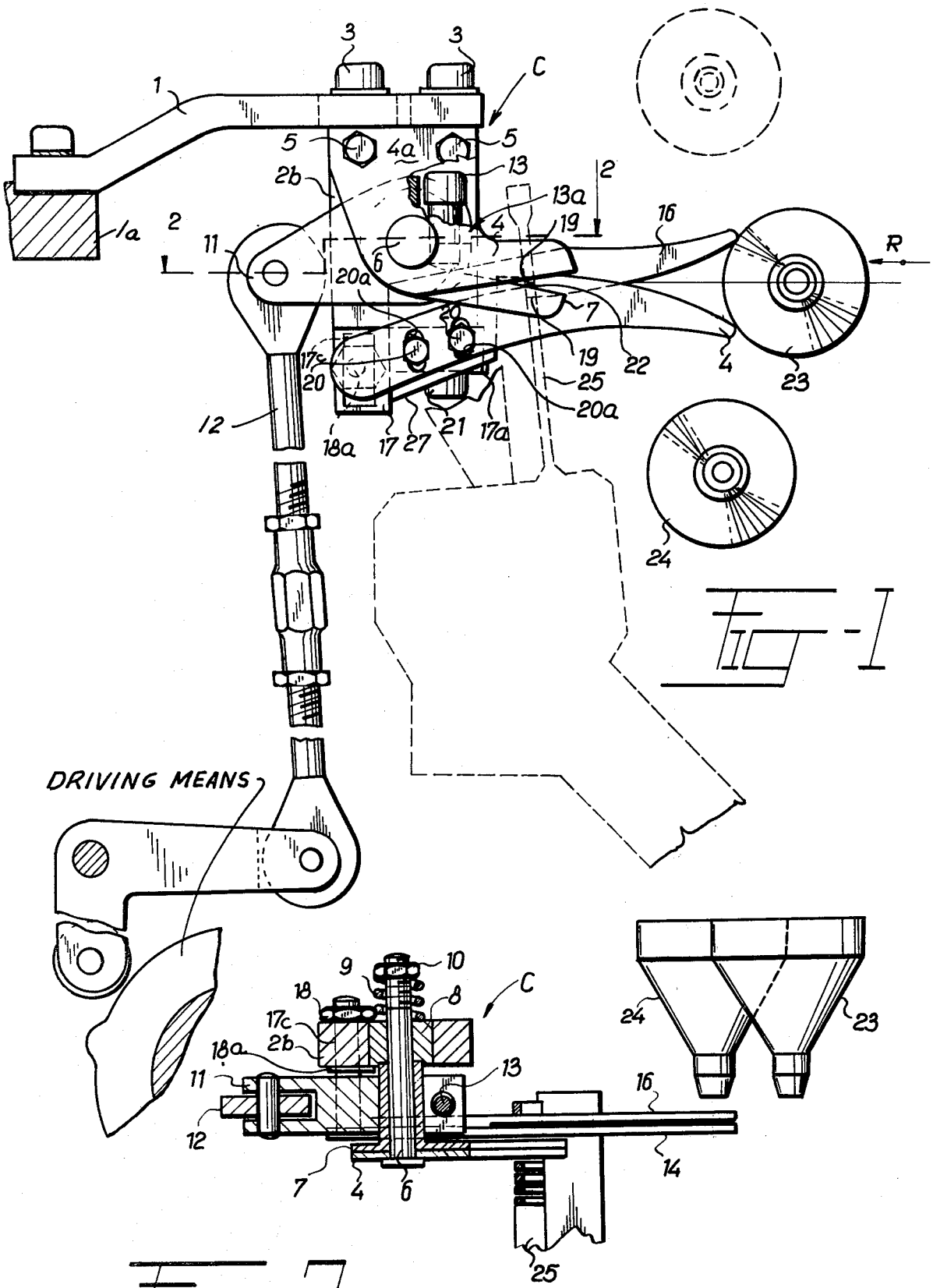
FIG. 1 is a view in side elevation of a cutting device oriented oppositely to the direction of weft insertion.
FIG. 2 is a view partially in plan and partially in section of the apparatus shown in FIG. 2, the section being taken along the broken line 2—2 in FIG. 1.

Turning first to FIGS. 1 and 2, there is there shown a weft cutting apparatus employed in a fragmentarily shown multi-weft loom in which weft is selectively applied from a plurality of nozzles, of which two are shown at 23 and 24. In FIG. 1 the weaving plane is designated by R, the reed of the loom by the character 25, and the weft cutting point by the character 22. The weft cutter C is mounted upon a bracket 1 which is fixedly secured to the loom frame, a portion of which is shown at 1*a*.

Figure 3:
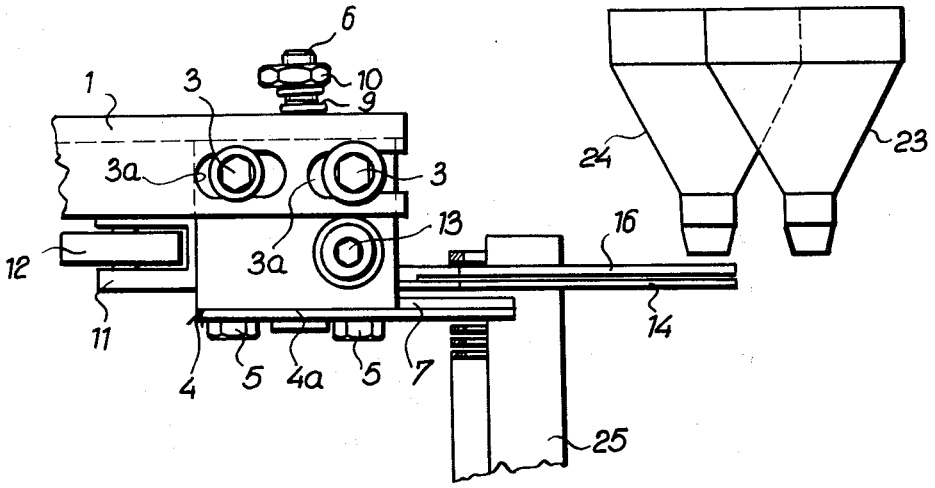
FIG. 3 is a view in top plan of the apparatus shown in FIG. 1.
Figure 4:
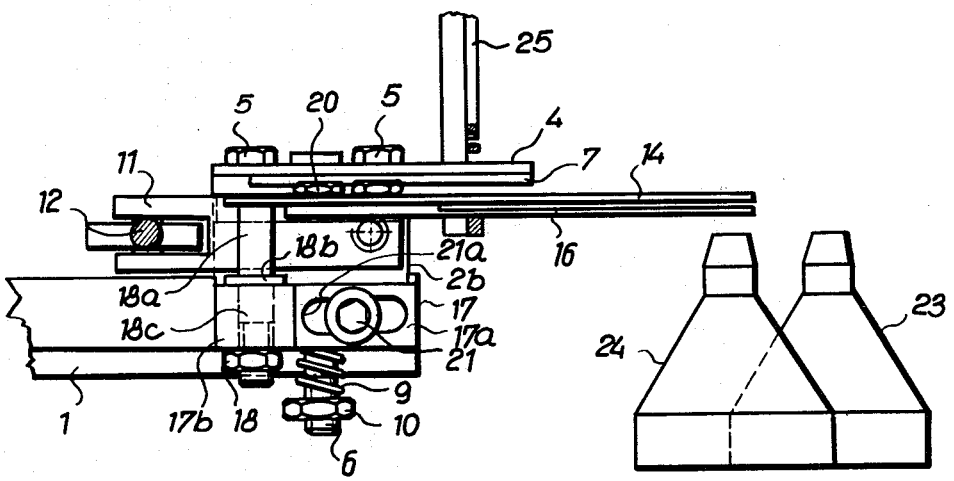
FIG. 4 is a view in bottom plan of the apparatus shown in FIG. 1.
Figure 5:
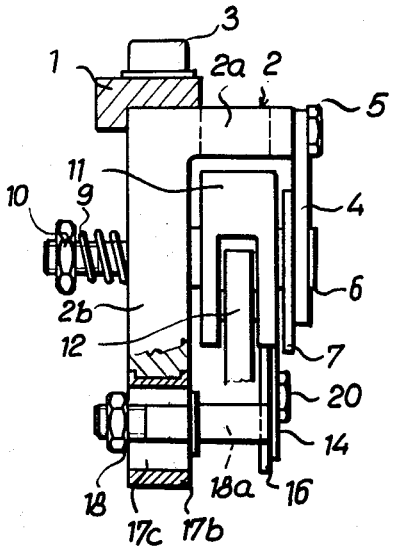
FIG. 5 is a view in end elevation of the apparatus of FIG. 1, looking in the direction from left to right in such figure.
Figure 6:
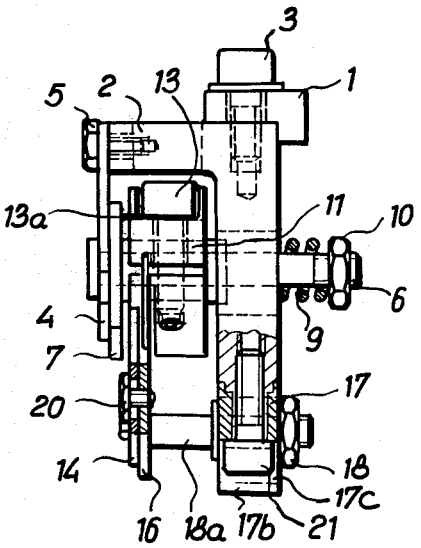
FIG. 6 is a view in end elevation of the apparatus of FIG. 1 looking in the direction from right to left in that figure.
Figure 7:
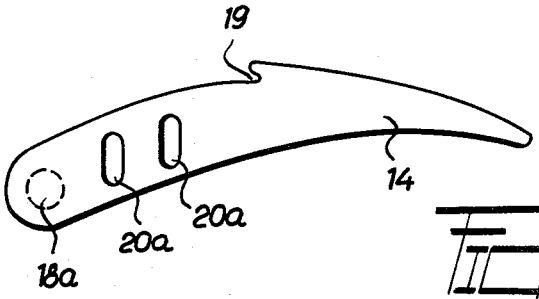
FIG. 7 is a view in side elevation of the lower shield blade of the apparatus of FIG. 1.

Weft cutter C has a main body or holder 2 which is L-shaped (FIG. 5), having an upper horizontal leg 2*a* and a vertical leg 2*b*. Body 2 is mounted on bracket 1 for horizontal adjustment with respect thereto by means of machine screws 3 which extend through elongated slots 3*a* (FIG. 3) in bracket 1 and are screwed into the upper leg 2*a* of member 2.

The upper cutting jaw 4 of the device C has a blade portion extending to the right in FIG. 1 and an upper plate portion 4*a* which is secured to the vertical leg 2*b* of the body 2 via machine screws 5 and thus remains fixed during operation of the cutter. A lower cutting blade 7, cooperating with blade 4, is disposed behind blade 4 as the two blades are shown in FIG. 1. Blade 7 oscillates about a pivot pin 6 journaled in a bushing 8 mounted in leg 2*b* of the body 2 as most clearly shown in FIG. 2. Thus pin 6 extends through a hole in the fixed blade 4 and through a sleeve 7*a* which is fixedly secured to the blade 7. The blades 4 and 7 are adjustably resiliently urged toward each other by a coil compression spring 9 which is telescoped over the free end of the pin 6 and acts between the bushing 8 and a nut 10 which is threadedly mounted on the outer end of the pin 6.

The movable blade 7 of the cutting device is oscillated in timed relation to the various loom functions, including the insertion of the weft, by an adjustable tie rod 12 which is reciprocated by means such as a cam or crank driven in timed relationship with the loom. The upper end of the tie rod 12 is connected by a clevis and pin means to the outer end of an arm 11 which is mounted upon the sleeve 7a for oscillation therewith about the pin 6. The arm 11 is secured to the sleeve 7a for angular adjustment with respect thereto about the axis of pin 6 by clamping means which include jaws connected to the arm 11 and pulled together by a screw 13 so as forcibly to engage the sleeve 7a. Suitable adjustment of the effective length of the tie rod 12 and of the connection between the arm 11 and the sleeve 7a permits the opening angle of the cutting blades 4, 6 to be changed and thus the position of the cutting point on such blades also to be changed. Such adjustments, taken in connection with the mounting of the cutting device C by the screws 3 and the slots 3a so that the device C may be adjusted in the direction of the weaving plane R, thereby to prolong the life of the cutting jaws several fold.

The cutting device 2 includes adjustable shields 14, 16 which makes it possible to introduce the weft between the edges of the cutting blades 4, 6 and to stabilize its position at the cutting point 22. As will be apparent in the drawings, particularly FIGS. 1 and 7 to 10 inclusive the blade portions of members 14 and 16, at the left in FIG. 1, are of generally the same configuration, the members being displaced 180° with respect to each other in the plane of FIG. 1, and presenting a path between their left hand ends which converges in the direction from right to left. Each of shields 14 and 16 has a weft entrapping dent 19 in the edge thereof which faces the other of such members, the respective dents 19 confronting each other as shown in FIG. 1.

Figure 8:
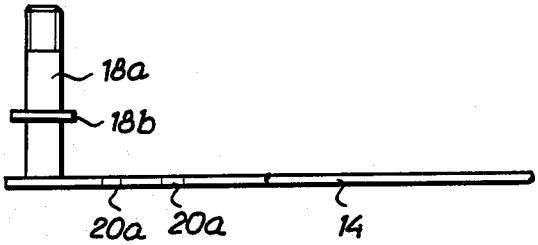
FIG. 8 is a view in top plan of the blade of FIG. 7.
Figure 10:
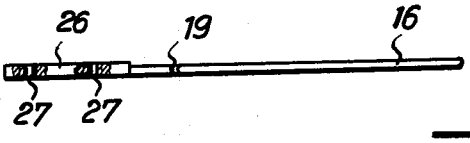
FIG. 10 is a view in top plan of the shield blade of FIG. 9.
Figure 9:
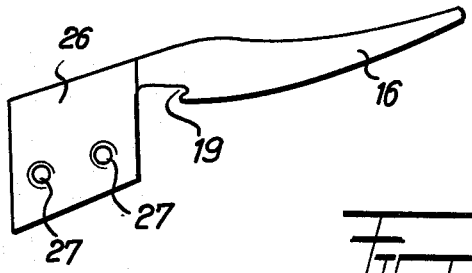
FIG. 9 is a view in side elevation of the upper shield blade of the apparatus of FIG. 1.

Turning to FIGS. 9 and 10, it will be seen that the upper shield 16 has a plate-like left hand end 26 having spaced holes 27 therethrough. Shield 14 has a pivot pin 18a fixedly secured to the left hand end thereof (FIGS. 7 and 8), pin 18a extending normal to the plane of the blade of shield 14. Through the left hand portion of member 14, to the right of pin 18a, there are two horizontally spaced vertically elongated openings 20a there through. Shield member 14 is secured to shield member 16 by machine screws 20 which extend through the slots 20a in member 14 and are threaded into holes 27 in member 16, such holes 27 being tapped. It will be seen that by loosening the screws 20 the position of the shield member 14 may be adjusted vertically with respect to shield member 16, the tightening of screws 20 preserving the adjusted relationship between members 14 and 16.

Shield members 14 and 16, thus held together in mutually adjusted position, are mounted upon the body or holder 2 by having the pin 18a on the shield member 14 received in a horizontal bore in a vertically elongated slot 17c in the lower end of the leg 2b of the body 2. As shown in FIGS. 1, 2 and 8, the pin 18a has a washer-like flange 18b affixed thereto intermediate its length, flange 18b overlapping the slot 17c and engaging the forward (FIG. 1) face of portion 17 of body 2. The pin 18a is held in vertically adjusted position by tightening a nut 18 on the threaded outer end of the pin 18a, nut 18 overlapping the rear edges of the slot 17c and engaging the rear face of portion 17 of body 2. It can thus be seen that the shields 14, 16 as a whole can be adjusted vertically and/or angularly about the axis of pin 18a relative to the body 2 by loosening the nut 18, adjusting the pivot pin 18a vertically as desired, and again tightening the nut 18. An angular adjustment of the shields about the axis of pin 18a may be made in the same manner.

The device of the invention operates as follows:

The weft is introduced by reed 25 between shields 14 and 16 via the introducing edges of the shields to the cutting point 22. Upon removal of the reed, the weft is held at the cutting point 22 in the entrapping opening formed by the opposing dents 19 of the shields 14, 16 according to the position of nozzles 23 and 24. In that position, the weft remains uncut during the whole time of weft insertion of the neighboring weft until the cutting moment. The cutting operation takes place the moment just prior to changing the positions of nozzles 23 and 24, the actual cutting being performed by reverse motion of the movable cutting jaw 7 against the stationary cutting jaw 4. This movement of the movable jaw is controlled by members 11 and 12 as above described.

The device of the invention is advantageously applied in looms operating with a plurality of different wefts.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a device for cutting wefts in a loom which weaves a fabric in a weaving plane, the loom having a driving means, a frame, and means for inserting wefts, said cutting device having a body which is fixedly positioned on the frame of the loom, said cutting device including a cutting mechanism having relatively movable opposed elongated blades of which at least one is driven by the driving means, said blades extending transverse to the weaving plane of the loom, the improvement which comprises mechanism driven by the driving means, means for adjustably connecting at least one of the cutting blades of the cutting mechanism to the driven mechanism, whereby selectively to adjust the position of the cutting point relative to the length of the opposed cutting blades, cutting shields mounted on the body of the device and extending in a plane parallel to the plane of the cutting blades to receive and guide the weft so as to position it between the cutting edges of the cutting blades, each of the shields having a dent therein, said dents confronting each other and entrapping the weft at the cutting point, and means for adjusting the shields so as to position the confronting dents thereof in alignment with the cutting point of the cutting blades.

2. A device as claimed in claim 1, wherein one of the cutting blades is fixed, and wherein the means for connecting the other, movable blade to the driven mechanism of the loom is adjustable so as to adjust the position of the cutting point along the lengths of the cutting blades.

3. A device as claimed in claim 2, wherein the means for connecting the movable blade of the cutting mechanism to the driven mechanism includes a link, and means for adjusting the length of the link.

4. A device as claimed in claim 2, wherein the means for connecting the movable blade of the cutting mechanism to the driven mechanism includes a lever pivotally connected to said link, a fixed pivot means for the lever, the movable blade of the cutting mechanism oscillating about said pivot means, and means drivingly connecting the lever and the movable blade, said last named means being adjustable whereby to adjust the angular relationship between the lever and the movable blade.

5. A device as claimed in claim 1, comprising means for adjustably securing the opposed shields together, and wherein the means for adjusting the connected shields relative to the cutting point adjusts the connected shields in the direction perpendicular to the weaving plane of the loom.

6. A device as claimed in claim 5, wherein the means for adjusting the connected shields comprises means mounting one of the shields on the body of the device.

7. A device as claimed in claim 6, comprising means for slidingly adjustably connecting said one of the shields to the body of the device, said connecting means also permitting adjustment of the connected shields angularly with respect to the weaving plane of the loom.

8. A device as claimed in claim 1, comprising means for adjusting the body of the cutting mechanism, upon which the cutting blades and the shields are mounted, in a direction parallel to the weaving plane of the loom and toward and away from the path of weft insertion thereof.

9. A device as claimed in claim 1, wherein the loom weaves with a plurality of wefts, and has means selectively to insert said wefts.

* * * * *